US009139314B2

(12) United States Patent
Ishikawa et al.

(10) Patent No.: US 9,139,314 B2
(45) Date of Patent: Sep. 22, 2015

(54) PACKAGING BAG FEEDER IN PACKAGING MACHINE

(71) Applicant: GENERAL PACKER CO., LTD., Aichi (JP)

(72) Inventors: Shinji Ishikawa, Alchi (JP); Masaaki Takahashi, Aichi (JP); Junya Hayashi, Aichi (JP)

(73) Assignee: GENERAL PACKER CO., LTD., Aichi (JP)

( * ) Notice: Subject to any disclaimer, the term of this patent is extended or adjusted under 35 U.S.C. 154(b) by 96 days.

(21) Appl. No.: 14/021,305

(22) Filed: Sep. 9, 2013

(65) Prior Publication Data

US 2014/0334909 A1 Nov. 13, 2014

(30) Foreign Application Priority Data

May 10, 2013 (JP) ..... 2013-099837

(51) Int. Cl.

| | |
|---|---|
| ***B65B 5/06*** | (2006.01) |
| ***B65B 43/18*** | (2006.01) |
| ***B65B 43/46*** | (2006.01) |
| ***B65B 35/18*** | (2006.01) |
| ***B65B 43/16*** | (2006.01) |
| ***B65B 51/14*** | (2006.01) |

(52) U.S. Cl.

CPC ..... *B65B 5/067* (2013.01); *B65B 35/18* (2013.01); *B65B 43/16* (2013.01); *B65B 43/18* (2013.01); *B65B 43/46* (2013.01); *B65B 43/465* (2013.01); *B65B 51/146* (2013.01)

(58) Field of Classification Search

CPC ..... Y10S 414/102; B65H 1/28; B65H 1/26; B65H 3/0833; B65H 3/46; B65B 61/186; B65B 43/04; B65B 43/30; B65B 43/34; B65B 43/18; B65B 43/14

USPC ..... 141/114; 198/418.6, 419.3, 470.1, 549, 198/732, 803.1; 271/104, 157, 227, 241, 271/253, 91, 95, 98; 414/795.8, 796.4, 414/796.5, 796.69, 797; 53/570, 571

See application file for complete search history.

(56) References Cited

U.S. PATENT DOCUMENTS

| | | | | | |
|---|---|---|---|---|---|
| 2,742,285 | A | * | 4/1956 | De Back | 271/98 |
| 2,941,799 | A | * | 6/1960 | Reincke | 271/92 |
| 3,509,689 | A | * | 5/1970 | Perrin | 53/571 |
| 3,656,744 | A | * | 4/1972 | Gray et al. | 271/253 |
| 3,662,875 | A | * | 5/1972 | Salomon | 198/419.3 |
| 3,884,278 | A | * | 5/1975 | Nakashima | 141/67 |
| 3,934,388 | A | * | 1/1976 | Stadlbauer et al. | 53/459 |
| 3,953,020 | A | * | 4/1976 | Ruf et al. | 271/14 |

(Continued)

FOREIGN PATENT DOCUMENTS

| | | | | |
|---|---|---|---|---|
| GB | 1242423 | A | * | 8/1971 |
| GB | 2087363 | A | * | 5/1982 |

(Continued)

*Primary Examiner* — Gregory Adams

(74) *Attorney, Agent, or Firm* — Cermak Nakajima & McGowan LLP; Tomoko Nakajima

(57) ABSTRACT

A packaging bag feeder in a packaging machine includes a bag magazine capable of accommodating a number of packaging bags in a stacked state, a separating mechanism which is configured to separate one of the packaging bags stacked on the bag magazine and a bag placement section on which the separated bag is placed. Every time one bag is placed on the bag placement section, the bag is held and fed to a subsequent packaging step.

7 Claims, 21 Drawing Sheets

(56) References Cited

U.S. PATENT DOCUMENTS

| | | | | | |
|---|---|---|---|---|---|
| 3,961,461 | A | * | 6/1976 | Ruf et al. | 53/571 |
| 4,729,209 | A | * | 3/1988 | Owensby et al. | 53/434 |
| 4,824,307 | A | * | 4/1989 | Johnson et al. | 414/798.2 |
| 4,884,389 | A | * | 12/1989 | McGregor | 53/571 |
| 4,970,847 | A | * | 11/1990 | Gradwohl | 53/573 |
| 5,201,166 | A | * | 4/1993 | Johnsen | 53/571 |
| 5,322,268 | A | * | 6/1994 | Okutsu et al. | 271/11 |
| 5,433,426 | A | * | 7/1995 | Bond | 271/92 |
| 5,819,509 | A | * | 10/1998 | McGregor et al. | 53/525 |
| 2001/0042673 | A1 | * | 11/2001 | Nakanishi | 198/419.3 |
| 2009/0241487 | A1 | * | 10/2009 | Actis | 53/563 |
| 2012/0192527 | A1 | * | 8/2012 | Manzon et al. | 53/459 |

FOREIGN PATENT DOCUMENTS

| | | | | |
|---|---|---|---|---|
| JP | 4011567 | B2 | | 9/2007 |
| JP | 4149466 | B2 | | 7/2008 |
| WO | WO 9722522 | A1 | * | 6/1997 |

* cited by examiner

PACKAGING BAG FEEDER IN PACKAGING MACHINE

CROSS-REFERENCE TO RELATED APPLICATIONS

This application is based upon and claims the benefit of priority from the prior Japanese Patent Application No. 2013-099837 filed on May 10, 2013, the entire contents of which are incorporated herein by reference.

BACKGROUND

1. Technical Field

The present disclosure relates to a packaging bag feeder in a packaging machine, which is suitable for use in feeding large-sized bags such as zippered bags or gusset bags.

2. Related Art

A packaging bag feeding manner in conventional packaging machines includes a magazine type (Japanese Patent No. JP-B-4149466) in which packaging bags stacked on a magazine are fed and a conveyor type (Japanese Patent No. JP-B-4011567) in which packaging bags are sequentially fed by a conveyor.

Zippered bags have zippers formed on upper portions, respectively. Accordingly, the upper portions of the bags become bulky when the bags are stacked one upon another. On the other hand, Gusset bags have gussets on both sides thereof respectively. Accordingly, the both sides of the gusset bags become bulky when the bags are stacked one upon another. As a result, both types of bags warp when stacked in the packaging bag feeder. This allows the conveyor type bag feeding but disallows the magazine type bag feeing. Furthermore, the use of large-sized bags necessarily increases the length of the conveyor even when the bags a are arranged so as to be shifted little by little on the conveyor, as shown in FIG. 21. This results in a problem that ensuring a space for the conveyor is difficult. Still furthermore, in the magazine type, packaging bags need to be loaded in an aligned manner, with the result that the magazine type is troublesome and reduces the production efficiency.

SUMMARY

Therefore, an object of the present disclosure is to provide a packaging bag feeder in a packaging machine, which can realize feeding of the zippered bags and gusset bags by the use of a magazine, can save a bag feeding space even in the case of a large-sized bag and can improve the production efficiency without loading packaging bags onto the bag magazine in an aligned manner.

The present disclosure provides a packaging bag feeder in a packaging machine, comprising a bag magazine capable of accommodating a number of packaging bags in a stacked state, a separating mechanism which is configured to separate one of the packaging bags stacked on the bag magazine and a bag placement section on which the separated bag is placed. In the packaging bag feeder, every time one packaging bag is placed on the bag placement section, the packaging bag is held and fed to a subsequent packaging step.

According to the above-described construction, the zippered bags and the gusset bags can be fed by the use of the magazine. This can save the bag feeding space even in the case of a large-sized packaging bag. Furthermore, the production efficiency can be improved without loading packaging bags onto the bag magazine in an aligned manner.

In an embodiment, the bag magazine is constructed of a conveyor including a first drive shaft, a first annular body configured to be rotatable with rotation of the first drive shaft, a first bag guide protruding from the first annular body, a second drive shaft, a second annular body configured to be rotatable with rotation of the second drive shaft, a second bag guide and a plurality of bag loading portions constructed between the first and second bag guides. The packaging bags stacked between the first and second bag guides are transferred by rotating the first and second bag guides in an identical direction. A distance between the first and second bag guides is adjustable by rotating the first and second drive shafts in opposite directions. According to the above-described construction, a bag magazine using a conveyor can be constructed with the result that the bag feeding space can be saved. Furthermore, a bag magazine can be configured so that a width of each bag loading portion is adjustable according to a width of the packaging bag.

In another embodiment, the separating mechanism includes at least one pair of suction pads which suck the packaging bag, and the suction pads are configured to transition from a horizontal state to an inclined state while sucking the packaging bag. According to the above-described construction, one of the packaging bags can be taken from the magazine more reliably.

In further another embodiment, the feeder further comprises a horizontal transfer unit which receives the packaging bag separated by the separating mechanism, gripping the packaging bag, the horizontal transfer unit then transferring the packaging bag to the bag placement section. According to the above-described construction, the packaging bag can more easily be transferred to the bag placement section.

In further another embodiment, the bag placement section has a bag position compensation unit. Consequently, the packaging bag can be disposed at a more accurate position.

In further another embodiment, the bag placement section has a positioning unit which positions a top edge of the packaging bag according to the packaging bag. Consequently, the packaging bag can be disposed at a more appropriate position according to the packaging bag.

In further another embodiment, the feeder further comprises a rotating arm which holds the packaging bag placed on the bag placement section and is rotated into a vertical attitude. In this feeder, the rotating arm has a holding unit which holds the packaging bag at both sides of the packaging bag. Consequently, since the packaging bag is held at both sides thereof, positional displacement of the packaging bag can be prevented more reliably.

In further another embodiment, the feeder further comprises a height compensation unit which compensates a height of the packaging bag held in the vertical attitude by the rotating arm. Consequently, the packaging bag held in the vertical attitude with the height of the top edge of the packaging bag can more reliably be fed to the subsequent step.

DETAILED DESCRIPTION

In the present disclosure, a packaging bag feeder 1 in a packaging machine P includes a bag magazine 2 capable of accommodating a number of packaging bags a in a stacked state, a separating mechanism 3 which is configured to separate one of the packaging bags stacked on the bag magazine, and a bag placement section on which the separated bag is placed. In the packaging bag feeder, every time one packaging bag is placed on the bag placement section, the packaging bag is held and fed to a subsequent packaging step. Thus, the packaging bag is not directly fed from the bag magazine 2 stacked with a number of packaging bags to the subsequent packaging step, but every time one packaging bag is placed on the bag placement section, the packaging bag is fed to the subsequent packaging step. Accordingly, even the zippered bags or the gusset bags do not result in a problem of warp in the use with the bag magazine. Furthermore, since the packaging bag is separated one by one by the separating mechanism 3, there is no possibility of taking two packaging bags together, with the result that the bag feed by the use of a magazine is realized. Furthermore, since the magazine type is employed, the bag feeding space can be saved even with the use of large-sized packaging bags. Still furthermore, since one packaging bag a is fed to the next packaging step every time the packaging bag a is placed on the bag placement section 4, the packaging bags a need not be placed in an aligned state on the bag magazine 2 and the production efficiency can be improved.

One embodiment will now be described with reference to FIGS. 1 to 20. A packaging bag feeder 1 in the packaging machine P according to the embodiment includes a bag magazine 2 capable of accommodating a number of packaging bags a in a stacked state, a separating mechanism 3 which is configured to separate one of the packaging bags a stacked on the bag magazine 2 and a bag placement section 4 on which the separated bag a is placed. The packaging bag feeder 1 is constructed so as to hold and feed one packaging bag to a subsequent packaging step every time the packaging bag is placed on the bag placement section. The structure of the packaging bag feeder 1 will be described in detail as follows.

Figure 1:
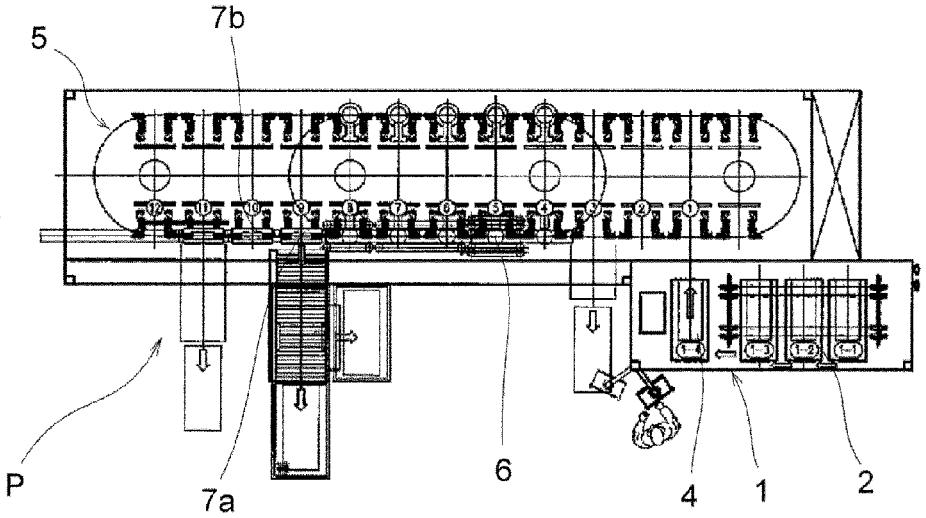
FIG. 1 is a schematic plan view of a packaging machine using the packaging bag feeder according to an embodiment.
Figure 2:
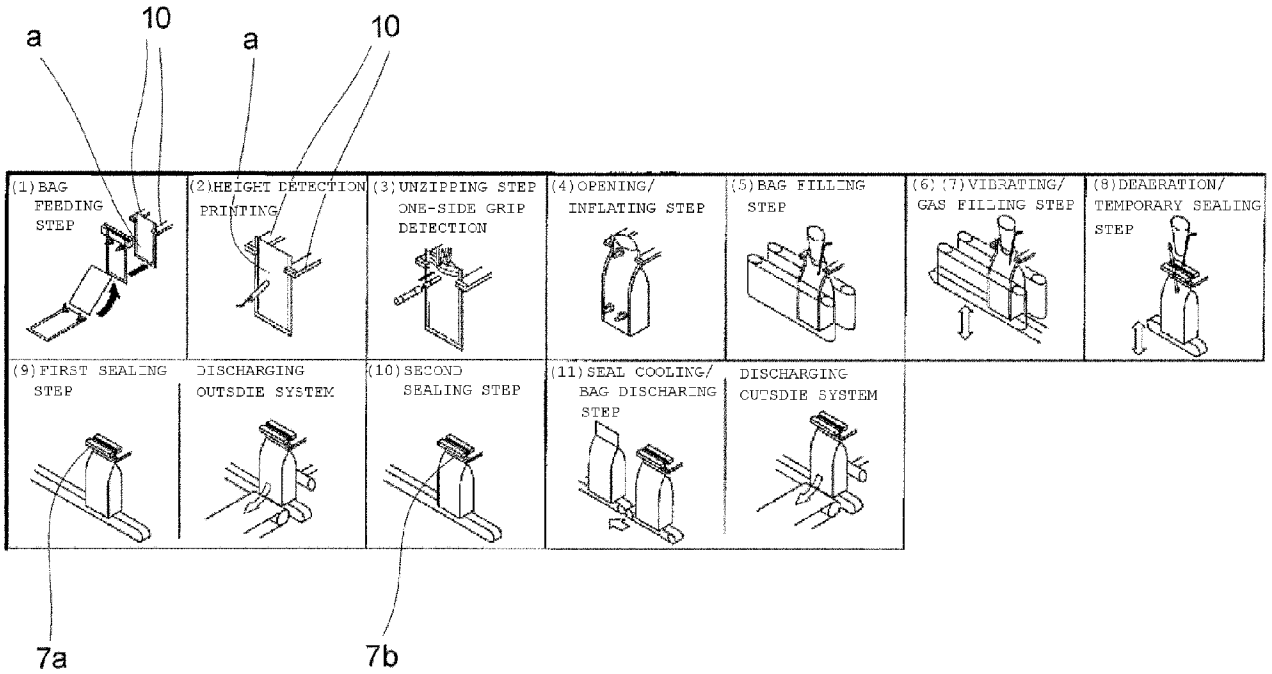
FIG. 2 is an illustration explaining a sequence of packaging step executed by the packaging machine shown in FIG. 1.

The packaging machine P employed in the embodiment fills a gusset bag with pet food as an article to be packaged. The gusset bag is classified into a large-sized bag having a length ranging from 600 mm to 1050 mm and a width ranging from 300 mm to 450 mm. The gusset bag has a zipper located near a bag mouth. As shown in FIGS. 1 and 2, the packaging machine P includes grip pairs 10 which holds the packaging bags a, a track type mover 5 intermittently moving the grip pairs 10 holding the packaging bag a to every packaging step, an article filling unit 6 which packages the article in the packaging bag a or a first sealing unit 7*a*, a second sealing unit 7*b* and the like.

As shown in FIG. 2, the packaging machine P executes (1) a bag feeding step of feeding packaging bags a to the grip pairs 10 by the packaging bag feeder 1, (2) a printing and printing inspection step of printing an expiration date and the like on the packaging bags a by an ink jet printer (IJP) and inspecting the print by a printing inspection camera, (3) a zipper opening of opening a zipper and a one-sided gripping detecting step of detecting occurrence of one-sided gripping by the grip pair 10, (4) a bag mouth opening and inflating step of opening a bag mouth of the packaging bag a and inflating the bag a, (5) a filling step of filling the packaging bag a with pet food by an article filling unit 6, (6) and (7) a vibrating and nitrogen-filling step of imparting vibration to the packaging bag a filled with pet food and filling the bag with nitrogen, (8) a deaeration and temporarily sealing step of deaerating an interior of the packaging bag a and temporarily sealing a part near the bag mouth, (9) a first sealing and rejecting step of applying a first sealing to the bag mouth of the packaging bag a and rejecting an empty bag filled with no pet food due to failure in opening and inflating and a bag with detected metal by discharging the defective packaging bags outside the system, (10) a second sealing step of applying a second sealing to the packaging bag a, (11) a cooling, discharging and discarding step of cooling the sealed part, discharging non-defective products and discarding imperfectly sealed products and the like outside the system, thereby accommodating the article (pet food) in the packaging bag a.

Figure 3:
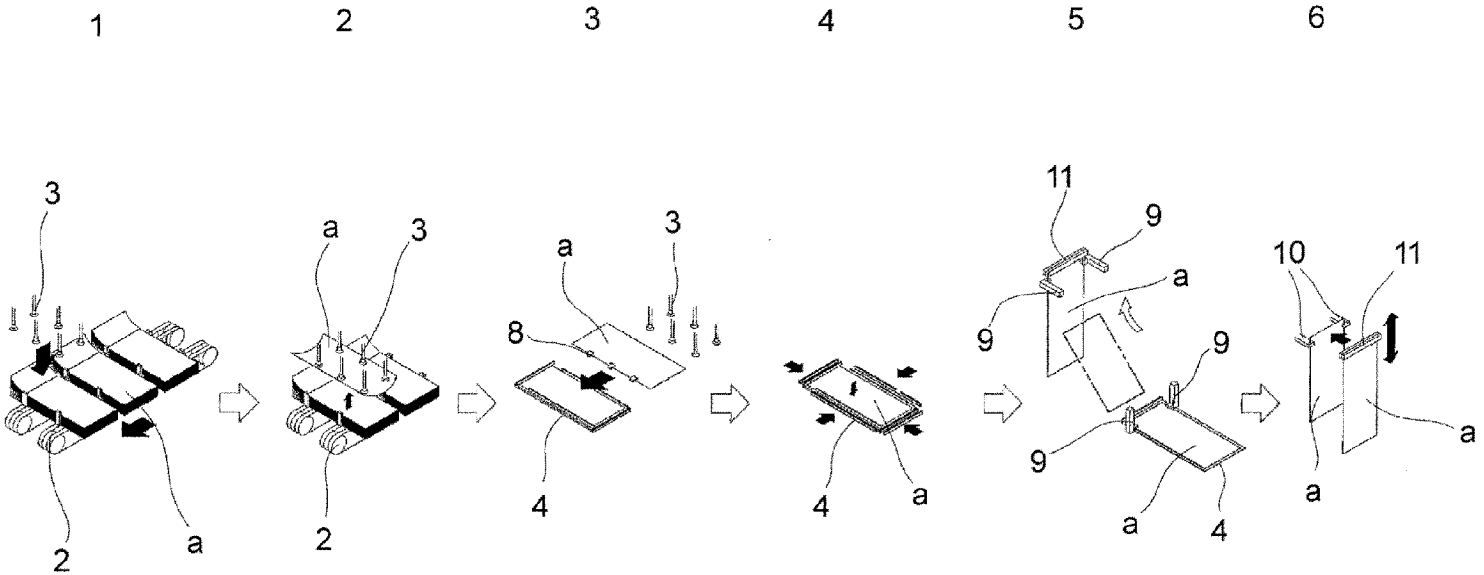
FIG. 3 is an illustration explaining a bag feeding step of the packaging bag feeder of the packaging machine.
Figure 4:
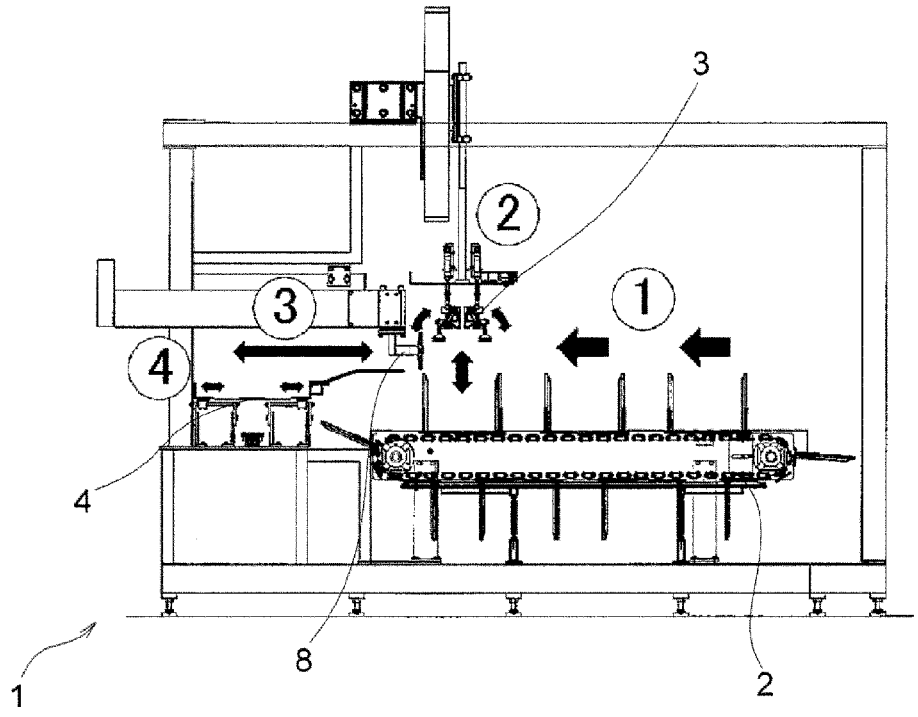
FIG. 4 is a schematic front view of the packaging bag feeder of one embodiment.
Figure 5:
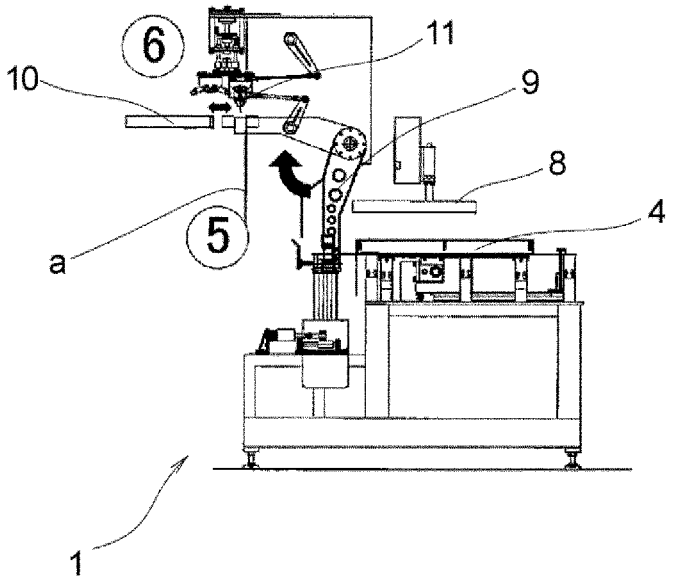
FIG. 5 is a schematic left side view of the packaging bag feeder shown in FIG. 4.

The packaging bag feeder 1 sequentially feeds the packaging bags a to grip pairs to feed the packaging bags a to a next packaging step in the aforementioned packaging machine P. As shown in FIG. 3, the packaging bag feeder 1 executes a bag feeding process which includes (1) a step of sequentially forwarding the packaging bags a to the downstream side by the bag magazine 2 (executed near step (1) in FIG. 4), (2) a step of separating one of the packaging bags a stacked on the bag magazine 2 by the separating mechanism 3 (executed near step (2) in FIG. 4), (3) a step of gripping and transferring the separated packaging bag a to the bag placement section 4 by a horizontal transfer unit 8 (executed near step 3 in FIG. 4), (4) a step of compensating a position of the packaging bag a transferred to the bag placement section 4 (executed near step 4 in FIG. 4), (5) a step of passing the packaging bag a held by a rotating arm 9 to a gripping unit 11 (executed near step 5 in FIG. 5) and (6) a step of passing the packaging bag a from the gripping unit 11 to the grip pair 10 after execution of compensation of the height of the packaging bag a (executed near step 6 in FIG. 5).

The bag magazine 2 is constructed of a conveyor including a first drive shaft 12, a first annular body 13 rotated with rotation of the first drive shaft 12, first bag guides 14 protruding from the first annular body 13, a second drive shaft 15, a second annular body 16 rotated with rotation of the second drive shaft 15, a second bag guide 17 protruding from the second annular body 16 and a plurality of bag loading portions 18 constructed between the first and second bag guides 14 and 17. When the first and second drive shafts 12 and 15 are rotated in an identical direction, the packaging bag a stacked between the first drive shafts 12 and the second drive shaft 15 is transferred. When the first and second drive shafts 12 and 15 are rotated in opposite directions, a distance between the first bag guides 14 and the second bag guide 17 is adjustable.

Figure 6:
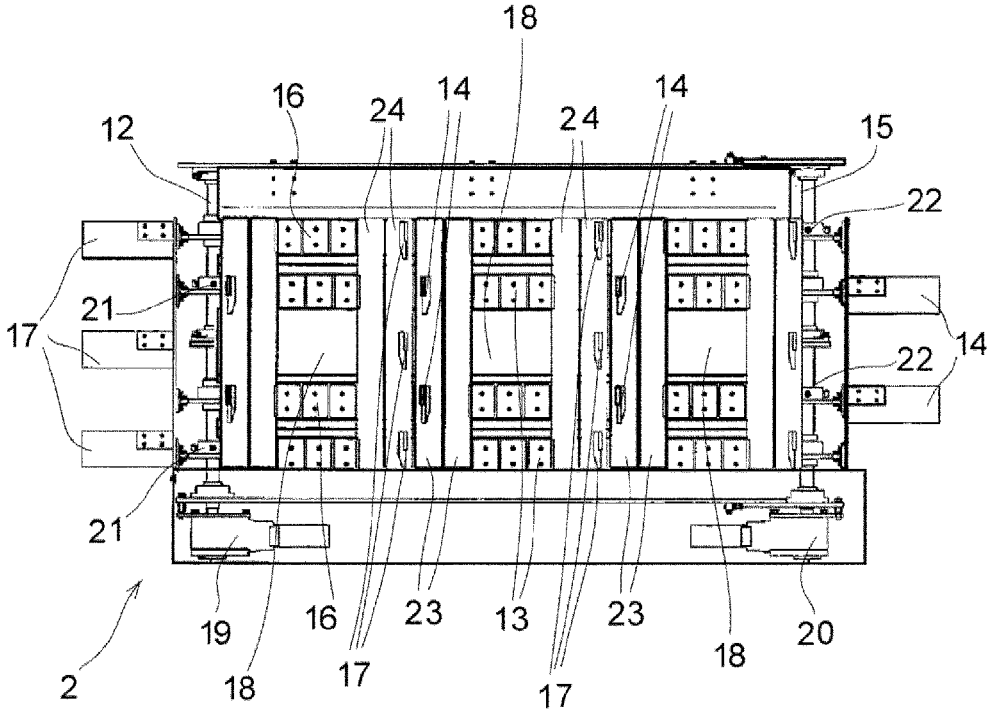
FIG. 6 is a plan view of a bag magazine in the packaging bag feeder shown in FIG. 3.

The construction and operation of the bag magazine 2 will now be described in detail. The first drive shafts 12 provided at one end side are configured to be rotatable forward and backward by a first drive unit (a servomotor) 19, as shown in FIG. 6. First sprockets 21 are fixed to the first drive shafts 21 so that the first annular body 13 (second and fourth chains from the top in FIG. 6 in the embodiment) is rotated with rotation of the first drive shaft 12, respectively. First width boards 23 are fixed to the first annular bodies 13 so as to extend in a direction perpendicular to the first annular bodies 13, respectively. First bag guides 14 are fixed to the first width boards 23 so as to protrude outward, whereby the first bag guides 14 are also rotated with rotation of the first annular bodies 13 respectively.

Figure 7:
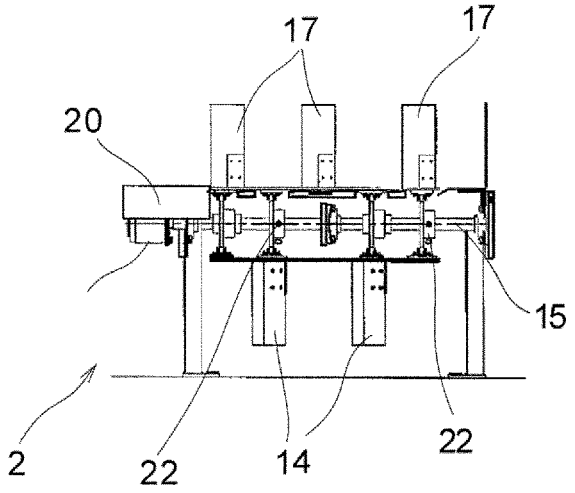
FIG. 7 is a right side view of the bag magazine shown in FIG. 6.

The second drive shaft 15 provided at the other end side is configured to be rotatable forward and backward by a second drive unit (a servomotor) 20. As shown in FIGS. 6 and 7, second sprockets 22 are fixed to the second drive shaft 15 so that the second annular bodies 16 (first and third chains from the top in FIG. 6 in the embodiment) are rotated with rotation of the second drive shaft 15. Second width boards 24 are fixed to the second annular bodies 16 so as to extend in a direction perpendicular to the second annular bodies 16. Second bag guides 17 are fixed to the second width board 24 so as to protrude outward, whereby the second bag guides 17 are also rotated with rotation of the second annular bodies 16.

Figure 8:
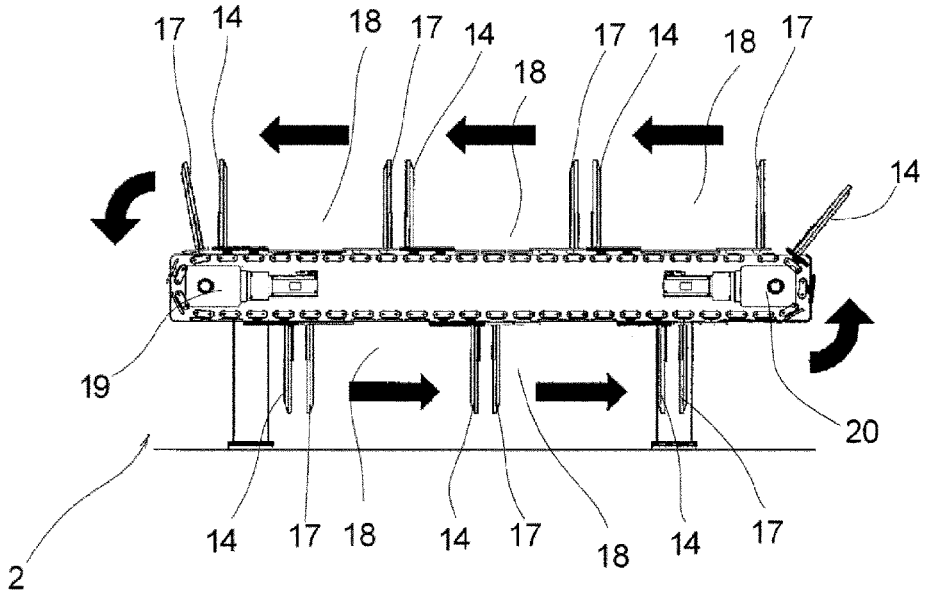
FIG. 8 is a front view of the bag magazine shown in FIG. 6, explaining the operation of the bag magazine.

A plurality of bag loading portions 18 is constructed between the first and second bag guides 14 and 17 as shown in FIG. 8. The packaging bags a are loaded on the bag loading portions 18 respectively. In this case, when the first and second drive shafts 12 and 15 are rotated in an identical direction, packaging bags a stacked between the first and second bag guides 14 and 17 (the bag loading portions 18) are transferred. Thus, the bag magazine 2 can be constructed which is provided with a plurality of bag loading portions 18 using a conveyor, with the result that the bag feeding space can further be saved.

Figure 9:
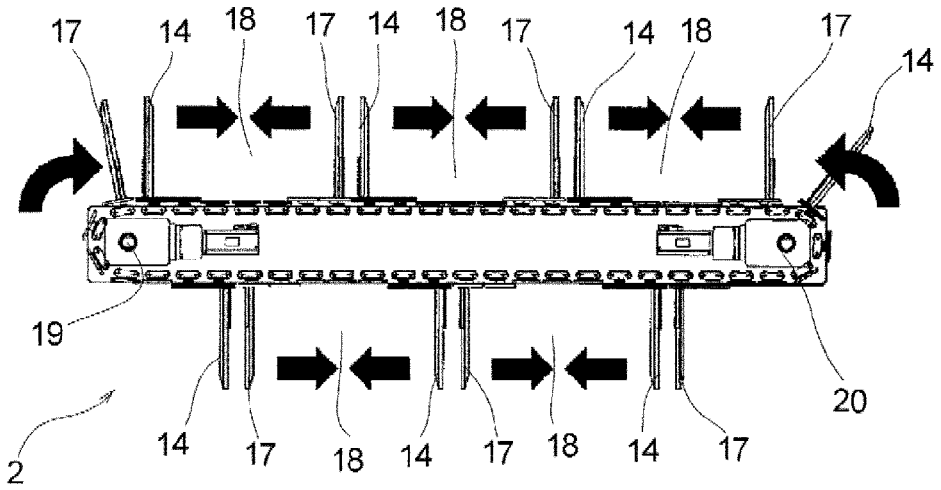
FIG. 9 is also a front view of the bag magazine shown in FIG. 6, explaining the operation of the bag magazine.

When the first and second drive shafts 12 and 15 are rotated in opposite directions, a distance between the first and second bag guides 14 and 17 can be adjusted, as shown in FIG. 9. As a result, the bag magazine 2 can adjust a width of each bag loading portion 18 according to the width of the packaging bag a. On the other hand, when the first and second drive shafts 12 and 15 are rotated in opposite directions, the distance between the first and second bag guides 14 and 17 is adjustable. This construction can be used to adjust the width of each bag loading portion 18 according to the width of the packaging bag a, as described above. In addition to this, even when the packaging bag is appropriately loaded on each loading portion 18, the above-described construction can be used to modify a loading state by bringing the packaging bag a from both widthwise ends.

Figure 10:
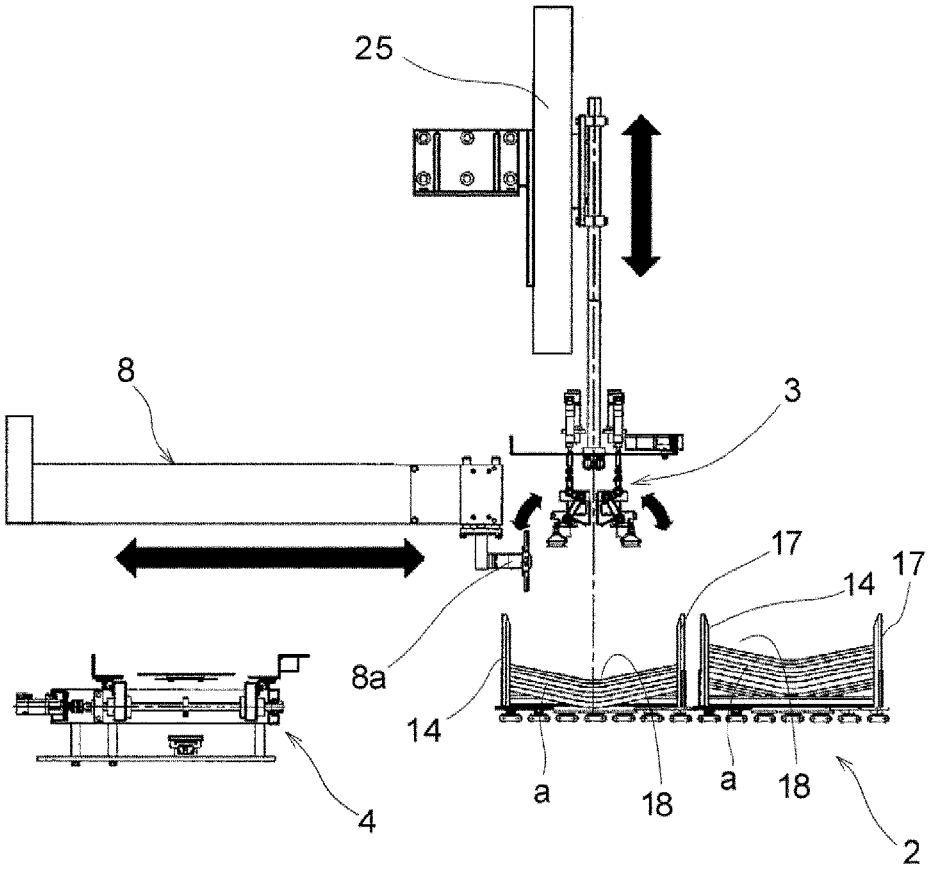
FIG. 10 is a schematic front view of a separating mechanism and periphery thereof in the packaging bag feeder shown in FIG. 3.

The separating mechanism 3 is provided for separating one of the packaging bags a stacked on the bag magazine 2. In the embodiment, the separating mechanism 3 is operated to take only one packaging bag from the bag loading portions 18 sent to the left end in FIG. 10 by the conveyor of the bag magazine 2, as shown in FIG. 10. There is a possibility that the packaging bag a loaded on the bag loading portion 18 may be warped when it is a zippered bag or a gusset bag, and in addition, there is a possibility that the packaging bags are slightly adhered to each other by static electricity or negative pressure. The separating mechanism 3 and an elevating unit (a vertical actuator) 25 are configured to be capable of reliably taking a single packaging bag a from the bag loading portion 18.

Figure 11:
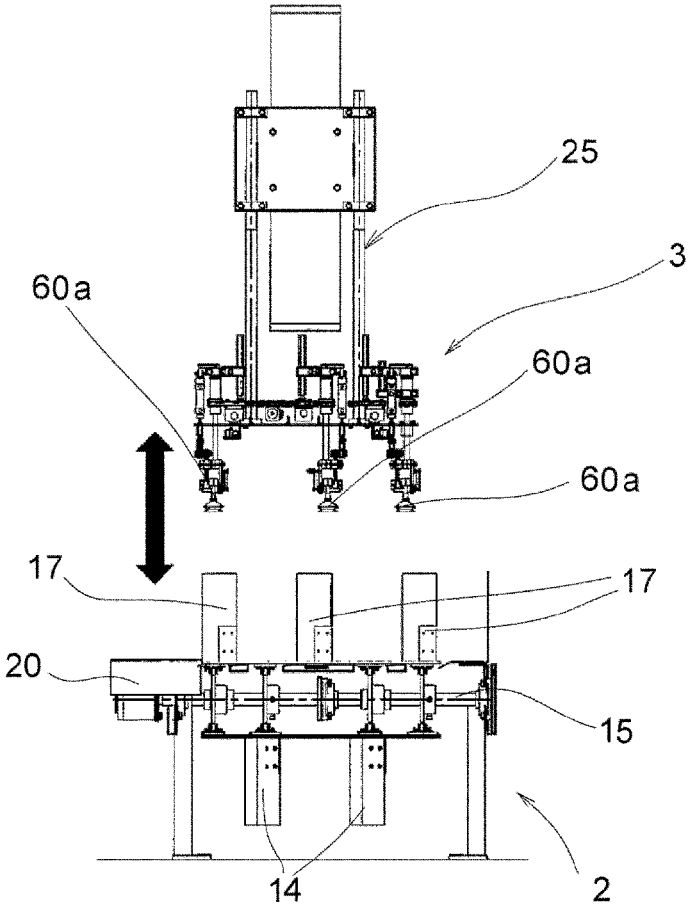
FIG. 11 is a schematic right side view of the separating mechanism and periphery thereof.
Figure 12:
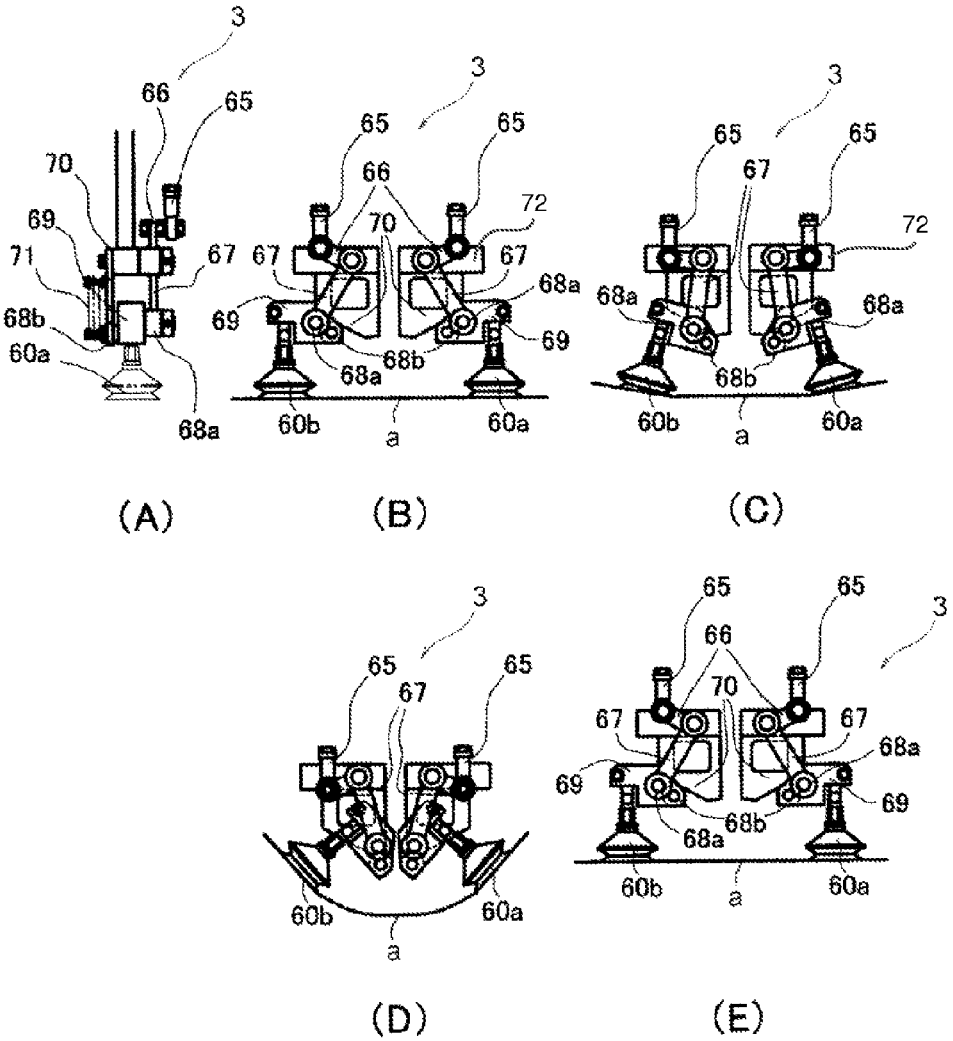
FIG. 12 is an illustration explaining the structure and the operation of the separating mechanism shown in FIG. 10.

The separating mechanism 3 adsorbs the packaging bag a by at least a pair of suction pads (three pairs of suction pads 60*a*, 60*b* disposed in a lengthwise direction of the packaging bag a, in the embodiment as shown in FIG. 11). The three suction pad pairs 60*a* and 60*b* are transferable from a horizontal state to an inclined state while adsorbing the packaging bag a.

More specifically, the separating mechanism 3 is provided with the three pairs of right and left suction pads 60*a* and 60*b* disposed in the lengthwise direction and adsorbing the widthwise right and left sides of the packaging bag a. However, the separating mechanism should not be limited to the above described. For example, the scope of the present invention covers the separating mechanism 3 which may cover two pairs of right and left suction pads and a centrally located suction pad for preventing paper from drooping. Describing the structure of the separating mechanism 3, an L-shaped lever has one end side 66 mounted on a drive unit (a cylinder) 65, and the L-shaped lever is rotatably connected to a mount 72. The L-shaped lever has the other end side 67 rotatably connected to a rotation support 68*a*. The mount 72 is formed with an inclined guide cam 70. On the other hand, a rotatable roller 68*b* is mounted on a base 69 on which the suction pads 60*a* and 60*b* are also mounted. The rotatable roller 68*b* is configured to be slid with the rotation support 68*a* serving as a starting point. The base 69 and the guide cam 70 are normally biased via an elastic member 71.

The operation of the separating mechanism 3 will be described. When the drive unit (the cylinder) 65 is reciprocated, the rotation pin 68*b* is guided via the rotation support 68*a* by the guide cam 70, so that the base 69, that is, the bottoms of the suction pads 60*a* and 60*b* are turned from a horizontal state to an outwardly directed inclined state, with the result that the packaging bag a adsorbed by the suction pads 60*a* and 60*b* is turned to a U-shape. Thus, one of the stacked packaging bags is separated (FIGS. 12C and 6D).

On the other hand, when the drive unit (the cylinder) 65 is reciprocated, the suction pads 60*a* and 60*b* are turned from the inclined state to the horizontal state (FIG. 12E). The packaging bag a held in the horizontal state is gripped by grip units 8*a* of the horizontal transfer unit 8.

The horizontal transfer unit 8 is configured to grasp and receive the single bag a separated by the separating mechanism 3, thereby transferring the packaging bag a to the bag placement section 4. The horizontal transfer unit 8 includes the grip units (chuck cylinders) 8*a* which hold, from the left side, the packaging bag a held in the horizontal state by the separating mechanism 3. Each grip unit 8*s* is configured to transfer the packaging bags a one by one every time being horizontally reciprocated. The horizontal transfer unit 8 is provided independently of the separating mechanism 3 in the embodiment. However, the scope of the invention covers the construction that the separating mechanism 3 transfers the single packaging bag to the bag placement section 4 while holding the packaging bag.

The bag placement section 4 is a section on which the packaging bag a separated by the separating mechanism 3 is placed. The packaging bag feeder 1 of the invention thus includes the bag placement section 4 and one packaging bag is fed to the subsequent packaging step every time the packaging bag a is placed on the bag placement section 4. The bag magazine 2 need not be loaded with the packaging bags a in an aligned state, with the result that the production efficiency can be improved.

The bag placement section 4 has a bag position compensation unit 26 for compensating the position of the packaging bag a in the widthwise or lengthwise direction, as shown in FIGS. 13 to 16. Consequently, the packaging bag a can be disposed at a more accurate position.

The bag position compensation unit 26 has a first position compensation unit compensating the position of the packaging bag a in the widthwise direction and a second position compensation unit compensating the position of the packaging bag a in the lengthwise direction.

The first position compensation unit has sideguides 27*a* and 27*b* which are provided so as to protrude upward and extend lengthwise at both widthwise sides and a stretch unit 28 (a ball screw 28*a* and a servomotor 28*b*) for increasing and reducing a widthwise distance between sideguides 27*a* and 27*b*. Every time one packaging bag a is placed on the bag placement section 4, the servomotor 28*b* is operated so that the ball screw 28*a* is contracted and with this, the widthwise distance between the sideguides 27*a* and 27*b* is reduced, whereby the position of the packaging bag a is compensated widthwise. After compensation of widthwise position, the servomotor 28*b* is operated so that the ball screw 28*a* is expanded thereby to return the sideguides 27*a* and 27*b* to the respective initial positions.

Figure 13:
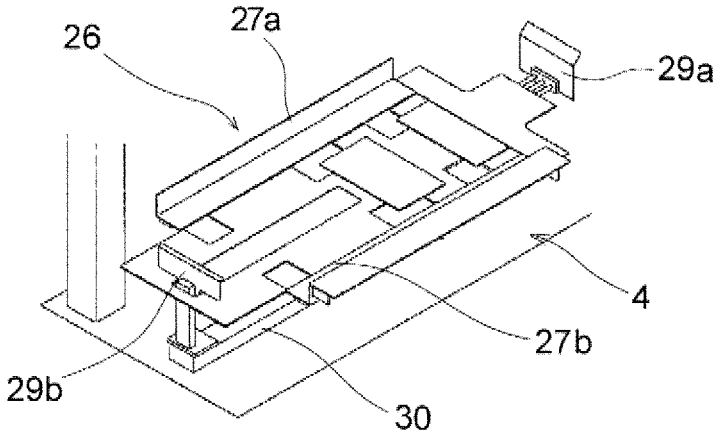
FIG. 13 is a schematic perspective view of a bag placement section in the packaging bag feeder shown in FIG. 3.
Figure 14:
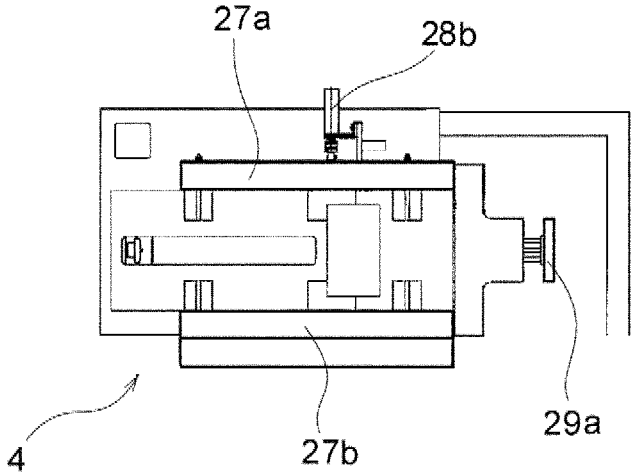
FIG. 14 is a schematic plan view of the bag placement section shown in FIG. 13.
Figure 15:
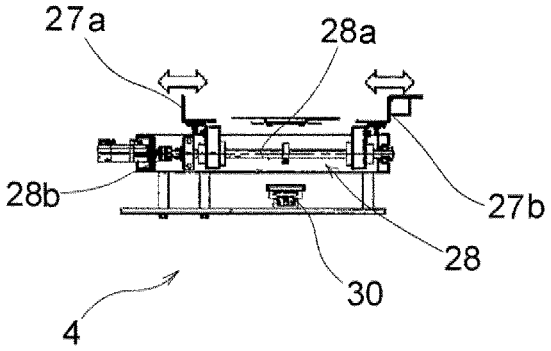
FIG. 15 is a schematic left side view of the bag placement section shown in FIG. 14.
Figure 16:
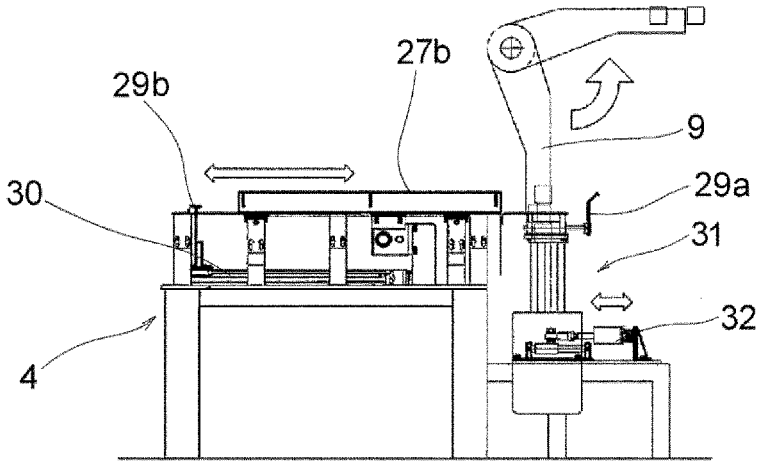
FIG. 16 is a schematic front view of the bag placement section shown in FIG. 13.
Figure 17:
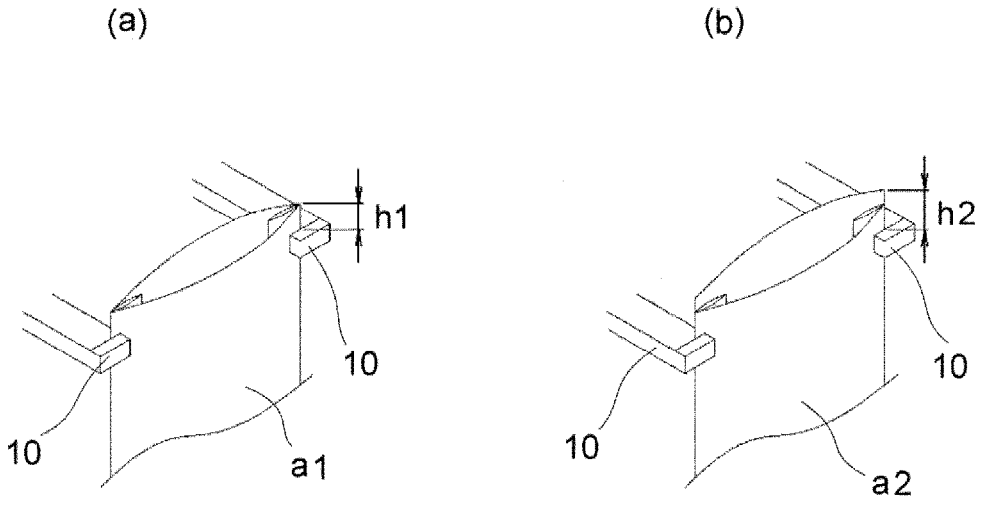
FIG. 17 is an illustration explaining the operation of a positioning unit in the bag placement section shown in FIG. 13.

The second position compensation unit is configured to operate as follows. As shown in FIG. 13 or 16, the second position compensation unit has upper side guides 29*a* provided so as to protrude upward at both lengthwise sides and extend widthwise and lower side guides 29*b* and an actuator 30 which reciprocates the lower side guides 29*b* so that a lengthwise distance between the upper and lower side guides 29*a* and 29*b* is increased and reduced. Every time one packaging bag a is placed on the bag placement section 4, the actuator 30 is operated so that lower side guides 29*b* are moved toward the upper side guides 29*a*. With this, the lengthwise distance between the upper and lower side guides 29*a* and 29*b* is reduced, whereby the position of the packaging bag a is compensated lengthwise. After the lengthwise positional compensation, the actuator 30 is operated to return the lower side guides 29*b* to the initial positions.

Furthermore, the bag placement section 4 has a positioning unit 31 which positions the top side of the packaging bag a, as shown in FIG. 16. The positioning unit 31 has the upper side guide 29*a* and a reciprocating unit 32 (an over-claw height changing cylinder) which reciprocates the upper side guide 29*a*. Consequently, the packaging bag can be disposed at a more suitable position according to each of the packaging bags having different over-claw heights.

More specifically, packaging bags include a packaging bag a1 having a shorter over-claw height h1 when held by the grip pair 10 as shown in FIG. 17A and a packaging bag a2 having a longer over-claw height h2 as shown in FIG. 17B. The position of the top side guide 29*a* is rendered variable so that the packaging bag can be disposed at a more specific position so as to correspond to the packaging bags with different over-claw heights.

Figure 18:
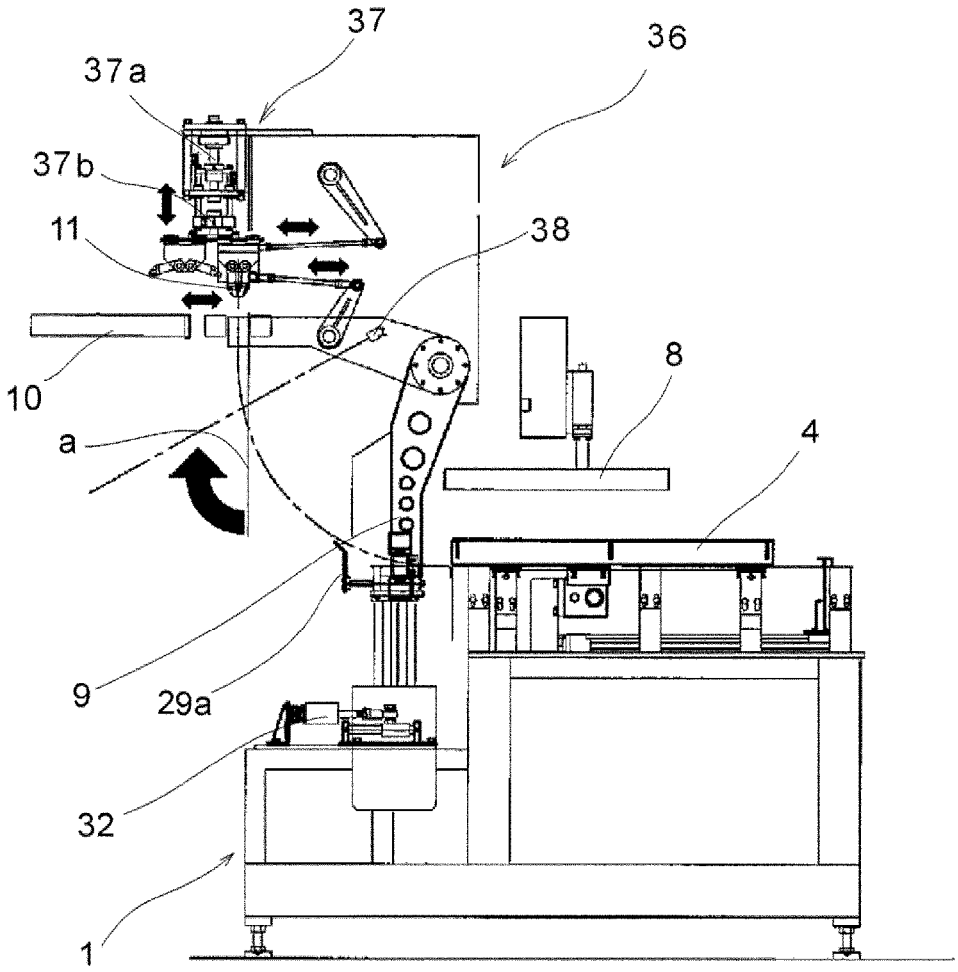
FIG. 18 is an illustration explaining a rotatable arm and periphery thereof in the packaging bag feeder shown in FIG. 13.
Figure 19:
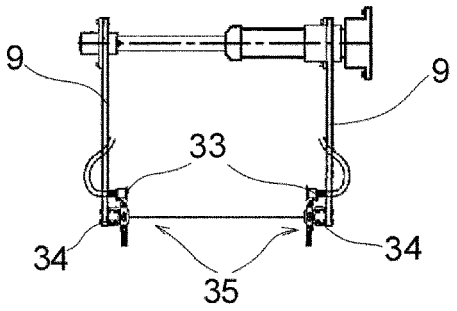
FIG. 19 is a right side view of the rotatable arm shown in FIG. 18 and periphery thereof.
Figure 20:
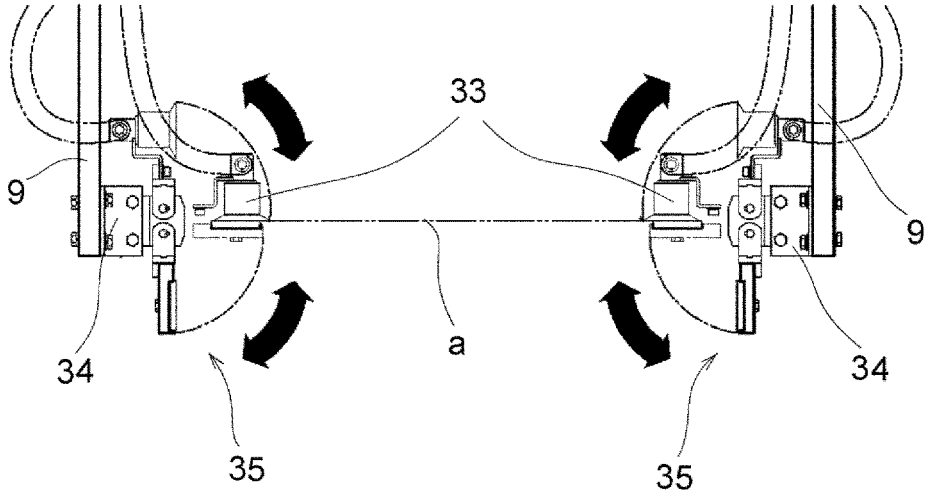
FIG. 20 is a partially enlarged view of the rotatable arm and periphery thereof shown in FIG. 19.
Figure 21:
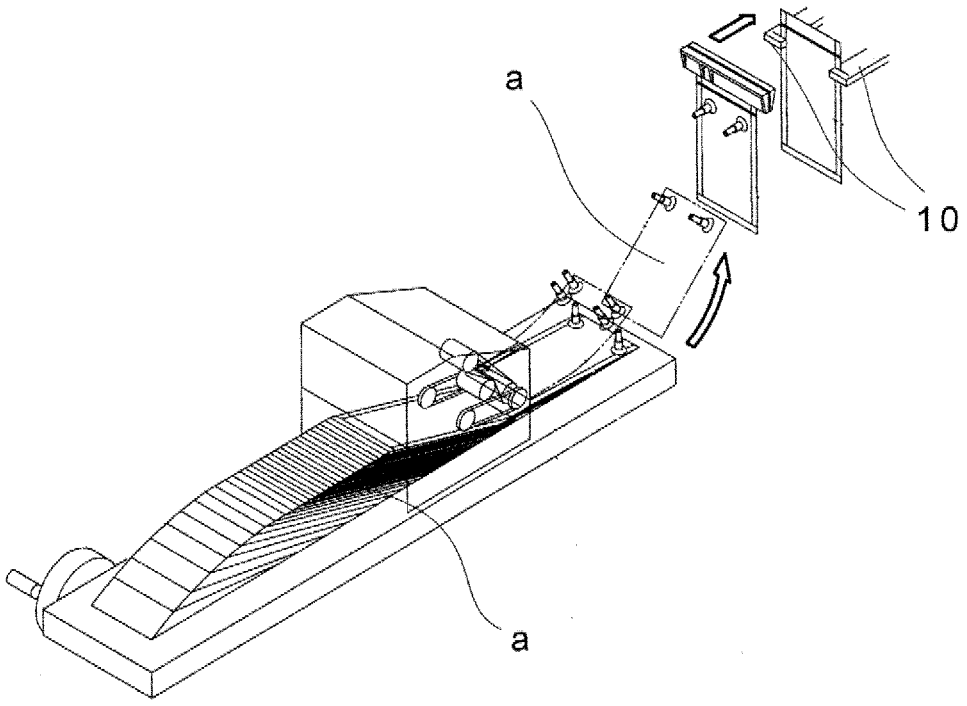
FIG.21 RELATED ART
FIG. 21 is a schematic perspective view of a packaging bag feeder of a conventional packaging machine.

Furthermore, the packaging bag feeder 1 has the pair of rotating arms 9 which hold one packaging bag a placed on the bag placement section 4 and is rotated into a vertical attitude, as shown in FIG. 18. Each rotating arm 9 has a holding unit 35 which holds the packaging bag a by a suction pad 33 sucking at one side of the packaging bag a and an elastic pressing plate of a chuck cylinder 34 pressing and holding the packaging bag a at the other side. This can further prevent the position of the packaging bag a from displacement when the packaging bag a is held between the suction pad and the elastic pressure plate, and placed on the bag placement section 4 and horizontally extends.

Furthermore, the packaging bag feeder 1 has a height compensation unit 36 which compensates the height of the packaging bag a held in the vertical attitude by the rotating arm 9.

The height compensation unit 36 includes a vertical drive mechanism 37 (having a ball screw 37*a* and a servomotor 37*b*) which vertically moves the holding unit 11, a rotary encoder which generates pulses with upward movement of the rotating arm 9 holding the packaging bag a and a sensor 38 which detects passing of the top side of the packaging bag a between the holding position of the packaging bag a by the rotating arm 9 and a receiving position by the holding unit, and a control controlling them.

The sensor 38 counts a reference pulse number while detecting passing of the top side of the packaging bag a when the rotating arm 9 holds the packaging bag a at a normal position and is then moved upward. The sensor 38 also counts a pulse number every time detecting passing of the top side of the packaging bag a in the case where the rotating arm 9 is moved upward while holding the packaging bag a. The control is configured to compare the aforementioned reference pulse number and the pulse number thereby to control an amount of vertical movement of the holding unit 11 by the vertical movement drive mechanism 37 according to an amount of comparison. Thus, the height position of the packaging bag a held by the holding unit 11 can be compensated, so that when subsequently, the holding unit 11 is horizontally moved to be held by the grip pair 10, the packaging bag is held with the height of the top side thereof being uniform. This can prevent visual quality of the packaging bag from being spoiled by displacement of seal position.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A packaging bag feeder in a packaging machine, comprising:

a bag magazine capable of accommodating a number of packaging bags in a stacked state;

a separating mechanism which is configured to separate one of the packaging bags stacked on the bag magazine; and a bag placement section on which the separated bag is placed, wherein every time one packaging bag is placed on the bag placement section, the packaging bag is held and fed to a subsequent packaging step, and wherein the separating mechanism includes:

at least a pair of suction pads for sucking the packaging bag;

a mount formed with an inclined guide cam for each suction pad, the guide cam having an inclined surface;

a rotatable roller reciprocating along the inclined guide along the inclined surface of the inclined guide cum;

an L-shaped lever rotatably connected on the mount, the L-shaped lever having one end side and an other end side, the one end side being mounted rotatably on a drive unit, and the other end side being rotatably connected to a rotation support;

a base on which a rotatable roller and each suction pad are mounted so that the rotatable roller is configured to be guided via the rotation support by the guide cam, and a bottom of each suction pad is turned from a horizontal state to an outwardly directed inclined state and also turned from the inclined state to the horizontal state.

2. The feeder according to claim 1, wherein:

the bag magazine is constructed of a conveyor including a first drive shaft, a first annular body configured to be rotatable with rotation of the first drive shaft, a first bag guide protruding from the first annular body, a second drive shaft, a second annular body configured to be rotatable with rotation of the second drive shaft, a second bag guide and a plurality of bag loading portions constructed between the first and second bag guides;

the packaging bags stacked between the first and second bag guides are transferred by rotating the first and second bag guides in an identical direction; and a distance between the first and second bag guides is adjustable by rotating the first and second drive shafts in opposite directions.

3. The feeder according to claim 1, further comprising a horizontal transfer unit which receives the packaging bag separated by the separating mechanism, gripping the packaging bag, the horizontal transfer unit then transferring the packaging bag to the bag placement section.

4. The feeder according to claim 1, wherein the bag placement section has a bag position compensation unit.

5. The feeder according to claim 1, wherein the bag placement section has a positioning unit which positions a top edge of the packaging bag according to the packaging bag.

6. The feeder according to claim 1, further comprising a rotatable arm which holds the packaging bag placed on the bag placement section and is rotated into a vertical attitude, wherein the rotatable arm has a holding unit which holds the packaging bag from both sides of the packaging bag.

7. The feeder according to claim 6, further comprising a height compensation unit which compensates a height of the packaging bag held in the vertical attitude by the rotatable arm.

* * * * *